US005249886A

United States Patent [19]

Huerta, Jr.

[11] Patent Number: 5,249,886

[45] Date of Patent: Oct. 5, 1993

[54] GROOVING APPARATUS

[76] Inventor: Francisco C. Huerta, Jr., 5816 Larcom La., Stockton, Calif. 95210

[21] Appl. No.: 835,539

[22] Filed: Feb. 14, 1992

[51] Int. Cl.[5] ..... E01C 23/02

[52] U.S. Cl. ..... 404/89; 15/144.1; 16/114 R

[58] Field of Search ..... 404/87, 89, 93, 94; 15/144.1; 16/114 R, 110 R, DIG. 24

[56] References Cited

U.S. PATENT DOCUMENTS

| | | | |
|---|---|---|---|
| 3,806,268 | 4/1974 | Francis | 404/89 |
| 4,070,128 | 1/1978 | Garrison | 404/89 |
| 4,570,340 | 2/1986 | Shaw | 16/114 R |
| 4,882,802 | 11/1989 | Levere, Jr. | 15/144.1 |
| 5,050,261 | 9/1991 | Hotacker | 15/144.1 |

*Primary Examiner*—William P. Neuder
*Attorney, Agent, or Firm*—Leon Gilden

[57] ABSTRACT

A grooving tool is arranged for imparting a groove relative to an underlying cementious pad, wherein the tool includes a float plate mounting a support boss thereon, with the support boss including a support flange to receive spaced parallel support flange receiving plates thereabout in a pivotal relationship, with the receiving plates fixedly mounted to a bottom surface of a support plate, the support plate including an elongate slot adjustably mounting a handle therealong to permit utilization of the tool about support beams and the like providing displacement of the handle relative medially of the float plate. A modification of the invention includes a fluid reservoir mounted to the support plate in fluid communication with a flexible delivery conduit, wherein the delivery conduit includes communication with a spray head positioned at a forward distal end of the float plate adjustably therealong relative to a magnetic positioning boss to permit for the fluid spraying of cement during a working procedure.

4 Claims, 4 Drawing Sheets

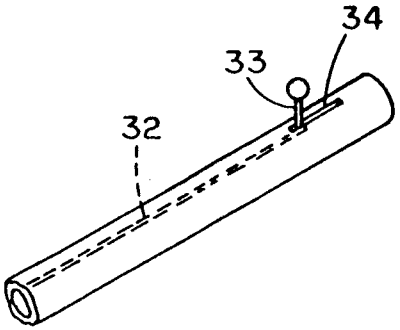
FIG. 10
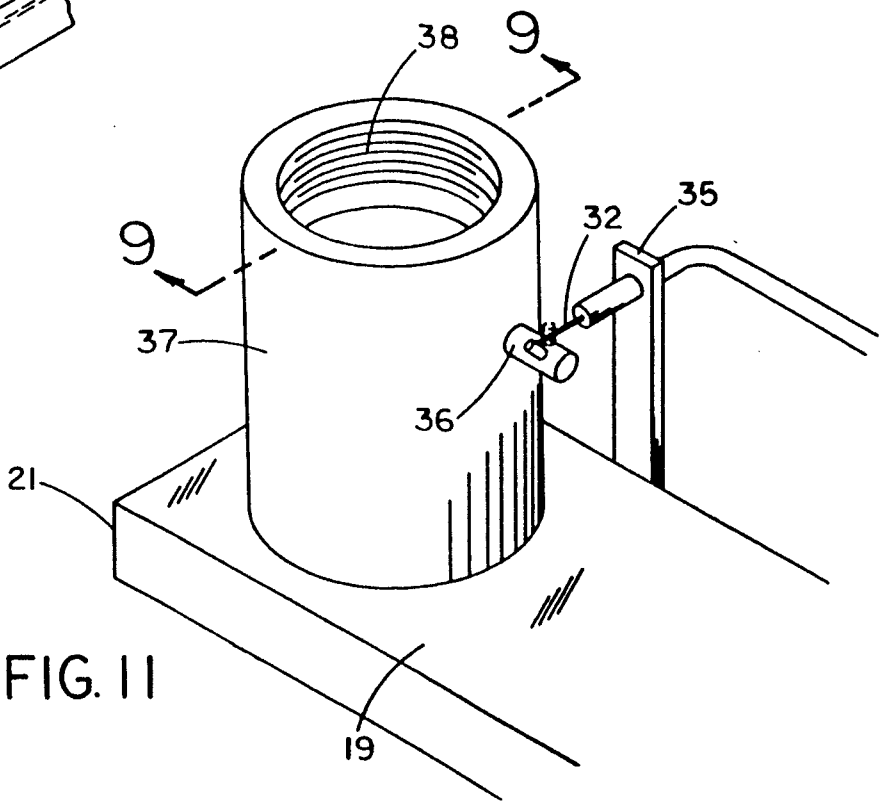
FIG. 11
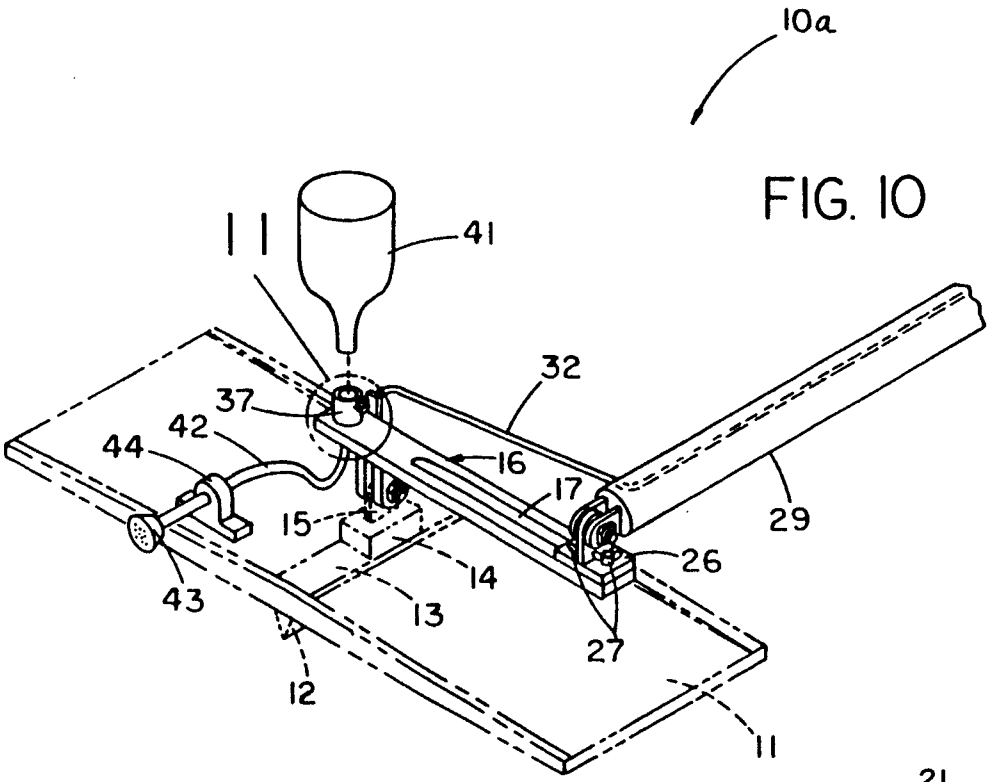

GROOVING APPARATUS

BACKGROUND OF THE INVENTION

1. Field of the Invention

The field of invention relates to groove tools, and more particularly pertains to a new and improved grooving apparatus wherein the same includes a float plate mounting a support boss and including a flange for imparting a groove to an underlying cementious pad.

2. Description of the Prior Art

Grooving tools of various types utilized in the cement art employ a fixed handle relative to the grooving structure, or alternatively of a relatively elaborate configuration of a type as illustrated in the U.S. Pat. No. 3,874,806 to Grist, et al. utilizing a plurality of moldings, including circular ribs to effect a grooving procedure.

U.S. Pat. No. 4,822,209 to Dragich sets forth a concrete groove including a pivotally mounted handle secured thereto.

U.S. Pat. No. 4,032,249 to Devitis sets forth a grooving tool for concrete wherein a plate is arranged for mounting to a cable, the cable directed to a drum and ratchet assembly to direct a float and grooving tool along a top surface of the concrete.

As such, it may be appreciated that there continues to be a need for a new and improved grooving apparatus which addresses both the problems of ease of use as well as effectiveness in construction in providing ease of manipulation and positioning of a handle for access about various work vertical posts permitting ease of grooving relative to the vertical post and underlying cementious plate and in this respect, the present invention substantially fulfills this need.

SUMMARY OF THE INVENTION

In view of the foregoing disadvantages inherent in the known types of cement grooving apparatus now present in the prior art, the present invention provides a grooving apparatus wherein the same includes bracket structure to permit displacement of a handle relative to a grooving tool float in a longitudinal orientation relative to the float. As such, the general purpose of the present invention, which will be described subsequently in greater detail, is to provide a new and improved grooving apparatus which has all the advantages of the prior art cement grooving apparatus and none of the disadvantages.

To attain this, the present invention provides a grooving tool arranged for imparting a groove relative to an underlying cementious pad, wherein the tool includes a float plate mounting a support boss thereon, with the support boss including a support flange to receive spaced parallel support flange receiving plates thereabout in a pivotal relationship, with the receiving plates fixedly mounted to a bottom surface of a support plate, the support plate including an elongate slot adjustbly mounting a handle therealong to permit utilization of the tool about the support beams and the like providing displacement of the handle relative medially of the float plate. A modification of the invention includes a fluid reservoir mounted to the support plate in fluid communication with a flexible delivery conduit, wherein the delivery conduit includes communication with a spray head positioned at a forward distal end of the float plate adjustably therealong relative to a magnetic positioning boss to permit for the fluid spraying of cement during a working procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved grooving apparatus which has all the advantages of the prior art cement grooving apparatus and none of the disadvantages.

It is another object of the present invention to provide a new and improve grooving apparatus which may be easily and efficiently manufactured and marketed.

It is a further object of the present invention to provide a new and improved grooving apparatus which is of a durable and reliable construction.

An even further object of the present invention is to provide a new and improved grooving apparatus which is susceptible of a low cost of manufacture with regard to both materials and labor, and which accordingly is then susceptible of low prices of sale to the consuming public, thereby making such grooving apparatus economically available to the buying public.

Still yet another object of the present invention is to provide a new and improved grooving apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an isometric illustration of a modification of the invention.

FIG. 11 is an enlarged isometric illustration of section 11, as set forth in FIG. 10.

DESCRIPTION OF THE PREFERRED EMBODIMENT

Figure 1:
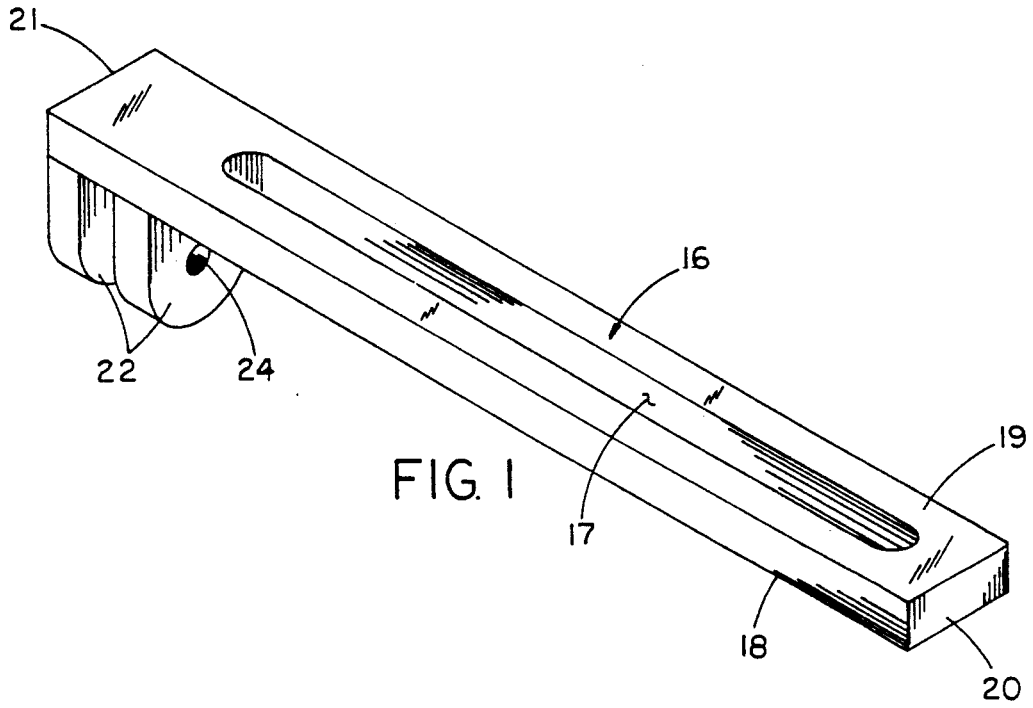
FIG. 1 is an isometric illustration of the support plate utilized by the invention.
Figure 2:
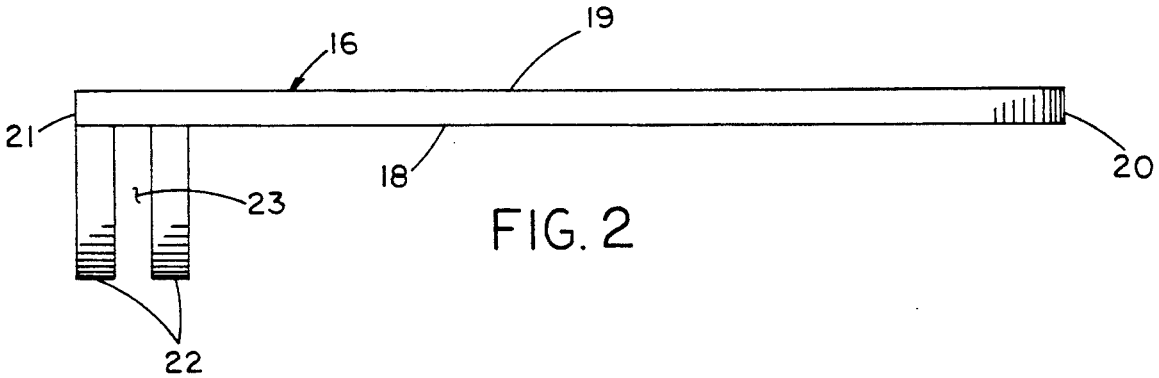
FIG. 2 is an orthographic front view, taken in elevation, of the support plate.
Figure 3:
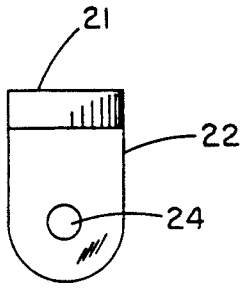
FIG. 3 is an orthographic end view of the support plate.
Figure 4:
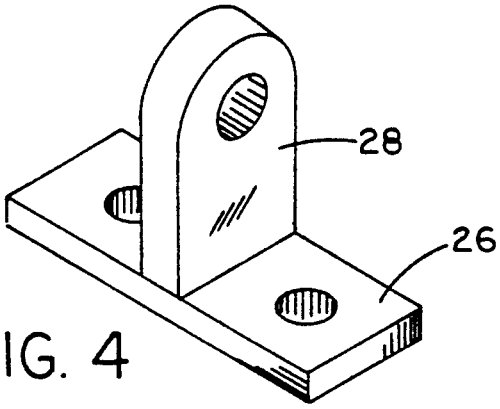
FIG. 4 is an isometric illustration of a slide plate structure utilized by the invention.
Figure 5:
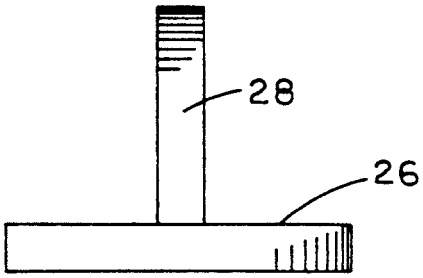
FIG. 5 is an orthographic front view of the structure, as set forth in FIG. 4.
Figure 6:
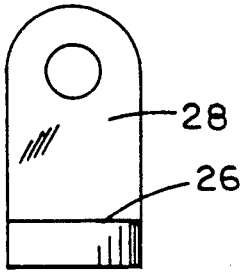
FIG. 6 is an orthographic end view of the slide plate.
Figure 7:
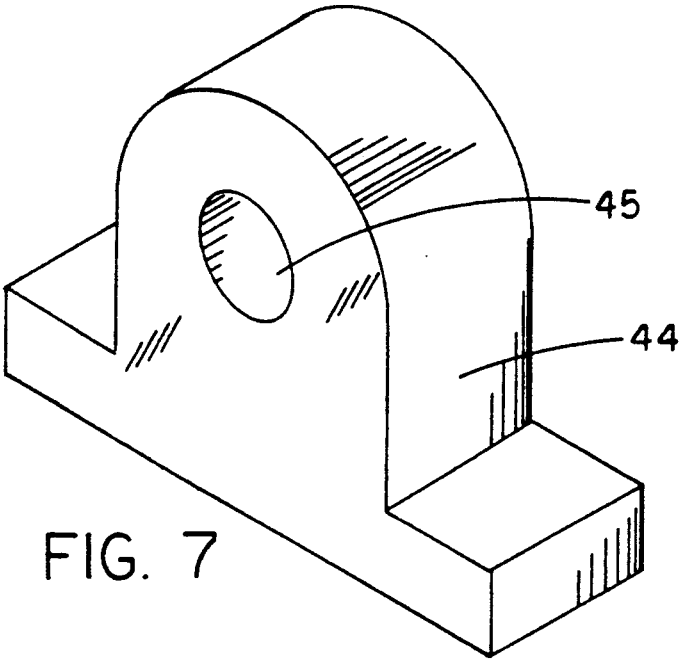
FIG. 7 is an isometric illustration of the magnetic positioning boss utilized by the invention.

With reference now to the drawings, and in particular to FIGS. 1 to 11 thereof, a new and improved grooving apparatus embodying the principles and concepts of the present invention and generally designated by the reference numerals 10 and 10*a* will be described.

More specifically, the grooving apparatus 10 of the instant invention essentially comprises a float plate 11 (see FIG. 8), with the float plate including a grooving rib 12 mounted medially of and integrally secured to a bottom surface of the float plate 11. A mounting plate 13 is positioned medially of the float plate to a top surface thereof over the grooving rib 12, including a support boss 14 secured thereto. The support boss 14 includes a support flange 15 orthogonally projecting upwardly relative to the support boss 14 and orthogonally oriented relative to a top surface of the float plate 11. A support plate 16 is provided to include an elongate enclosed slot 17 orthogonally directed through the support plate from a bottom wall 18 to a top wall 19. The support plate 16 is defined by a first end wall 20 and a second end wall 21. Spaced parallel support flange receiving plates 22 are orthogonally mounted to the support plate bottom wall 18 adjacent the second end 21 spaced apart to define a receiving plate spacing 23 therebetween. Coaxial bores 24 are directed through the receiving plates 22 to receive an axle 25 therethrough for securement of the support flange 15 within the receiving plate spacing 23 as the support flange 15 includes a support flange bore (not shown) to receive the axle 25 therethrough. A slide plate 26 is slidably mounted to the support plate top wall 19, and includes a plurality of fasteners 27 directed therethrough into and through the slots 17 for selective securement of the slide plate 26 along the support plate top wall 19. A slide flange 28 is orthogonally mounted to a top surface of the slide plate 26 to permit pivotal securement of an elongated handle 29 to the slide plate 26. The elongated handle 29 includes a bifurcated handle lower end 30 formed with a lower end axle 31 directed through the bifurcated lower end 30 and the slide plate flange 28. In this manner, relative displacement of the handle 29 relative to the support flange 15 is provided permitting user clearance and spacing relative to a grooving relative to an underlying cement pad (not shown) to be grooved by the grooving rib 12.

Figure 9:
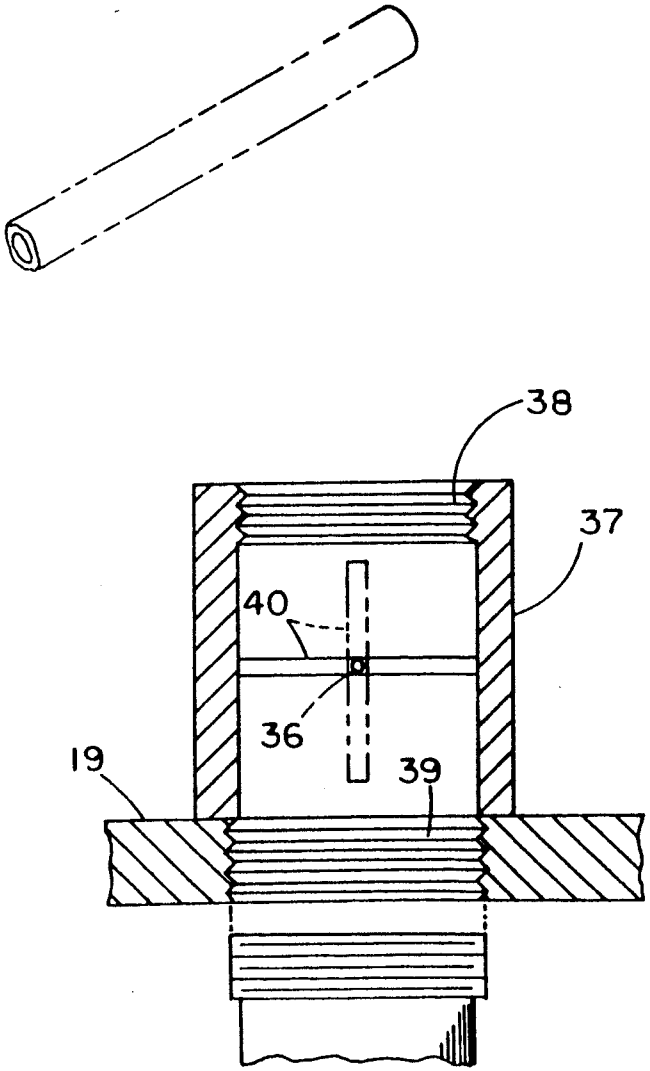
FIG. 9 is an orthographic cross-sectional illustration of a support cylinder, as illustrated in FIG. 10.
Figure 8:
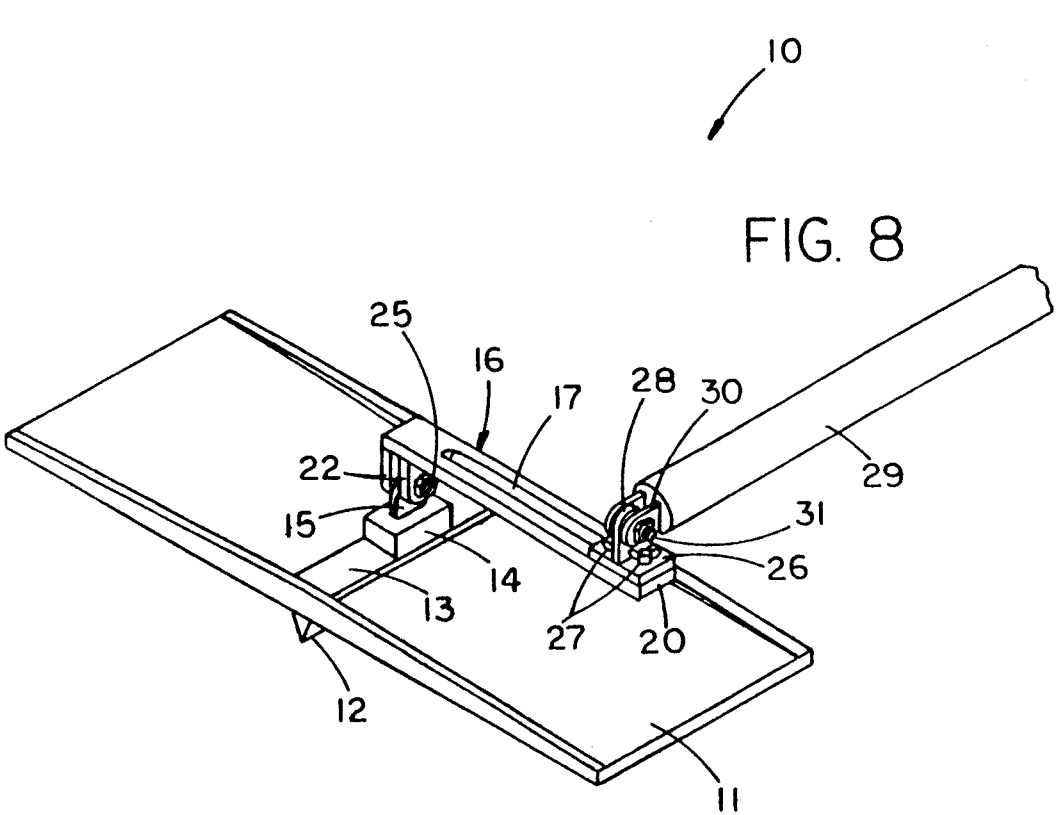
FIG. 8 is an isometric illustration of the instant invention.

The modified apparatus 10*a*, as illustrated in the FIG. 10 for example, includes a control cable 32 directed through the handle, with its upper distal end secured to a control cable lever 33 that is slidably mounted through a lever slot 34 within the handle 29. The control cable 32 is directed from the handle adjacent the handle lower distal end to a support bracket 35 mounted to the support plate 16. A support cylinder 37 is fixedly mounted to the support plate top wall 19 orthogonally oriented thereto to include an upper threaded end 18. A support plate threaded bore coaxially aligned with the support cylinder 17 is directed through the support plate 19, as illustrated in FIG. 9. The bore 39 has threadedly secured thereto a flexible delivery conduit 42, wherein the upper threaded end 38 threadedly receives a fluid reservoir 41 to direct fluid through the support cylinder 37 into a spray head 43 mounted to a forward distal end of the flexible delivery conduit 42. The spray head 43 is mounted within a magnetic positioning boss 44 within a positioning boss bore 45 (see FIG. 7) to permit positioning of the spray head 43 as desired relative to the float plate 11 to provide for dampening and adding of water to a cementious pad to enhance ease of grooving of the pad structure. A value plate 40 is pivotally mounted within the support cylinder 37 about a throttle shaft 36 diametrically directed through the support cylinder 37 and projecting exteriorly thereof having secured thereto a forward distal end of the control cable 32, whereupon rotation of the throttle shaft 36 and the associated valve plate 40 by the control lever 33 permits selective fluid flow through the spray head 43 from the reservoir 41.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A grooving apparatus, comprising, a float plate, the float plate including a float plate bottom surface, with the float plate bottom surface including a grooving rib medially bisecting the bottom surface extending downwardly therefrom, and a support boss mounted medially of a top surface of the float plate, with the support boss including a support flange orthogonally oriented relative to the support boss and to the top surface of the float plate, and a support plate, the support plate including a support plate top wall spaced from and parallel a support plate bottom wall, and a support plate first end spaced from a support plate second end, and an elongate enclosed slot directed through the support plate orthogonally oriented relative to the support plate bottom wall and the support plate top wall, and a plurality of spaced, parallel support flange receiving plates fixedly and orthogonally mounted to the support plate bottom wall adjacent the support plate second end, the receiving plates defining a receiving plate spacing therebetween, with the support flange positioned within the receiving plate spacing, and an axle orthogonally directed through the receiving plates and the support flange for pivotally mounting the support plate relative to the float plate, and a handle, the handle including a bifurcated lower distal end, the bifurcated lower distal end fixedly mounted to a slide plate, and the slide plate adjustably mounted relative to the elongated enclosed slot.

2. An apparatus as set forth in claim 1 wherein the slide plate includes a plurality of fasteners directed through the slide plate and through the enclosed slot to adjustably secure the slide plate relative to the enclosed slot and the support plate top wall, and a slide flange orthogonally mounted to a top surface of the slide plate, the slide plate flange including a further axle, the further axle directed through the bifurcated lower end of the handle and through the slide plate flange to pivotally mount the bifurcated lower end to the slide plate.

3. An apparatus as set forth in claim 2 including a support cylinder fixedly mounted to the support plate top wall adjacent the second end, support cylinder including a throttle shaft diametrically directed through the support cylinder projecting exteriorly of the support cylinder, and a control cable, the control cable including a lower distal end mounted to the throttle shaft exteriorly of the support cylinder, and the control cable including an upper distal end, and the control cable directed through the handle, with the control cable upper distal end positioned within the elongated handle, and a lever pivotally mounted within a lever slot, the lever slot positioned within the handle adjacent a handle upper end, and the control cable secured to the lever below the lever slot, whereupon pivotment of the lever effects rotation of the throttle shaft, and the throttle shaft including a valve plate mounted fixedly to the throttle shaft within the support cylinder to effect metering of fluid flow through the valve plate, and a fluid reservoir mounted removably relative to an upper distal end of the support cylinder, and a lower distal end of the support cylinder aligned with a support plate bore, the support plate bore positioned below the valve plate, and a flexible delivery conduit mounted to the support plate bore, and the delivery conduit including an outer distal end spaced from the support plate bore, and the outer distal end including a spray head mounted thereto, the spray head arranged for securement selectively to the float plate.

4. An apparatus as set forth in claim 3 including a positioning boss, the positioning boss formed of a ferromagnetic material and the float plate formed of a ferrous material to permit magnetic adherence of the positioning boss relative to the float plate, and the positioning boss including a positioning boss bore directed therethrough, and the delivery conduit directed through the positioning boss bore to permit selective positioning of the delivery conduit and the spray head relative to the float plate.

* * * * *